US011749919B2

(12) United States Patent
Jin

(10) Patent No.: US 11,749,919 B2
(45) Date of Patent: Sep. 5, 2023

(54) ADAPTING CABLE STRUCTURE

(71) Applicant: ENERGY FULL ELECTRONICS CO., LTD., New Taipei (CN)

(72) Inventor: Xushen Jin, New Taipei (CN)

( * ) Notice: Subject to any disclaimer, the term of this patent is extended or adjusted under 35 U.S.C. 154(b) by 233 days.

(21) Appl. No.: 17/286,466

(22) PCT Filed: Feb. 10, 2020

(86) PCT No.: PCT/CN2020/074621
§ 371 (c)(1),
(2) Date: Apr. 18, 2021

(87) PCT Pub. No.: WO2021/159233
PCT Pub. Date: Aug. 19, 2021

(65) Prior Publication Data
US 2022/0123485 A1 Apr. 21, 2022

(51) Int. Cl.

| | |
|---|---|
| ***H01R 12/62*** | (2011.01) |
| ***H01B 7/36*** | (2006.01) |
| ***H01R 4/70*** | (2006.01) |
| ***H01R 31/06*** | (2006.01) |
| *H01B 7/08* | (2006.01) |
| *H01R 12/58* | (2011.01) |

(52) U.S. Cl.
CPC ..... *H01R 12/62* (2013.01); *H01B 7/365* (2013.01); *H01R 4/70* (2013.01); *H01R 31/06* (2013.01); *H01B 7/0823* (2013.01); *H01R 12/58* (2013.01)

(58) Field of Classification Search
CPC ..... H01R 12/00; H01R 12/52; H01R 12/58; H01R 12/62; H01R 4/70; H01R 31/06; H01B 7/365; H01B 7/0823
See application file for complete search history.

(56) References Cited

U.S. PATENT DOCUMENTS

| | | | | |
|---|---|---|---|---|
| 3,786,172 A * | 1/1974 | Conley | H05K 3/328 | 174/257 |
| 4,640,562 A * | 2/1987 | Shoemaker | H01R 12/774 | 439/495 |
| 4,934,943 A * | 6/1990 | Klein | H01R 12/737 | 439/248 |
| 5,276,817 A * | 1/1994 | Matschke | H01R 12/79 | 439/59 |
| 5,281,150 A * | 1/1994 | Bundga | H01R 12/62 | 439/497 |

(Continued)

FOREIGN PATENT DOCUMENTS

| | | |
|---|---|---|
| CN | 106329261 A | 1/2017 |
| CN | 206331804 U | 7/2017 |

(Continued)

*Primary Examiner* — Thanh Tam T Le

(57) ABSTRACT

An adapting cable structure includes a cable, a first circuit board and a second circuit board. The cable is used to transfer a power signal or a control signal. The first circuit board includes a plurality of contacting parts and a plurality of first welding parts. Another end of the cable is on the second circuit board and the plurality of the contacting parts are located at two sides of the first circuit board. The plurality of welding parts are connected to one end of the cable. Furthermore, a pattern of a text or a specific design is placed on the cable. The pattern is used to improve the appearance or the identification of the cable.

11 Claims, 7 Drawing Sheets

(56) References Cited

U.S. PATENT DOCUMENTS

| | | | | |
|---|---|---|---|---|
| 7,044,748 | B2 * | 5/2006 | Korsunsky | H01R 12/52 439/631 |
| 8,425,236 | B2 * | 4/2013 | Cipolla | H05K 1/144 439/59 |
| 9,373,903 | B2 * | 6/2016 | Chang | H01R 12/594 |
| 9,490,586 | B1 * | 11/2016 | Horning | H01R 12/716 |
| 10,038,262 | B1 * | 7/2018 | Behziz | H01R 12/7082 |
| 10,199,141 | B2 | 2/2019 | Chin | |
| 10,770,814 | B2 * | 9/2020 | Swain | H05K 3/366 |
| 11,088,481 | B2 * | 8/2021 | Castiglione | H01R 13/516 |
| 11,355,875 | B2 * | 6/2022 | Wang | H01R 12/53 |

FOREIGN PATENT DOCUMENTS

| | | | |
|---|---|---|---|
| CN | 207541969 | U | 6/2018 |
| CN | 209374841 | U | 9/2019 |
| CN | 209692077 | U | 11/2019 |
| CN | 211151003 | U | 7/2020 |
| WO | 2019244008 | A1 | 12/2019 |

* cited by examiner

ADAPTING CABLE STRUCTURE

This application is a US national phase application based upon an International Application No. PCT/CN2020/074621, filed on Feb. 10, 2020, which claims the priority of Chinese Patent Application No. 201922138593.9, entitled "ADAPTING CABLE STRUCTURE", filed on Dec. 3, 2019, the disclosure of which is incorporated herein by reference in its entirety.

FIELD OF THE INVENTION

The present invention relates to an adapting cable structure, and more particularly, to an adapting cable structure configured to connect electronic devices.

BACKGROUND

The flexible flat cable (FFC) is widely used in electronic devices because of its flexibility. Furthermore, the FFC often has a connector for electrical connection and is used to be flexibly bended. However, the appearances of electronic products need to be well designed in nowadays. This means that the conventional FFC not only needs to transfer signals, but also needs to be easily assembled and have a good appearance.

SUMMARY

One objective of an embodiment of the present invention is to provide an adapting cable structure, which makes the cable have a firmer structure, which is not easily loosen. Furthermore, the pattern on the cable improves the appearance and identification of the entire structure. Thus, the adapting cable structure and its assembly/disassembly capability are both improved.

According to an embodiment of the present invention, an adapting cable structure is disclosed. The adapting cable structure comprises: a cable, configured to transfer a power signal or a control signal; a first circuit board comprising a plurality of contacting parts and a plurality of first welding parts; and a second circuit board; wherein another end of the cable is on the second circuit board and the plurality of the contacting parts are located at two sides of the first circuit board; and the plurality of welding parts are connected to one end of the cable.

Optionally, a number of the plurality of the contacting parts is greater than a number of the plurality of first welding parts, and a distance between two adjacent contacting parts of the plurality of contacting parts is longer than a distance between two adjacent welding parts of the plurality of first welding parts.

Optionally, the second circuit board comprises a plurality of second welding parts and a plurality of third welding parts, and the plurality of the second welding parts are connected at one end of the cable.

Optionally, the adapting cable structure further comprises a connector, comprising a plurality of connector pins, welded with the plurality of third welding parts.

Optionally, a number of the third welding parts is greater than a number of the second welding parts and a distance between two adjacent third welding parts is longer than a distance between two adjacent second welding parts.

Optionally, the cable comprises a plurality of first conductors and a plurality of second conductors, each of the first conductors is covered by a first insulating coat and each of the second conductors is covered by a third insulating coat.

Optionally, the cable comprises a plurality of second insulating coats, and each of the first insulating coats is covered by one of the second insulating coats.

Optionally, a thickness of the third insulating coats is greater than a thickness of the first insulating coats or a thickness of the second insulating coats.

Optionally, the adapting cable structure further comprises a first fixing part, configured to fix the first circuit board.

Optionally, the first fixing part comprises a first shell and a second shell, and the first welding parts of the first circuit board are located between the first shell and the second shell.

Optionally, the first shell has a first positioning hole, the second shell has a second positioning hole, the first circuit board has a first circuit board positioning hole, and a fixing device passes through the first positioning hole, the first circuit board positioning hole and the second positioning hole to fix the first circuit board between the first shell and the second shell.

Optionally, the adapting cable structure further comprises a second fixing part, configured to fix the second circuit board.

Optionally, the second fixing part comprises a third shell and a fourth shell, and the second welding parts of the second circuit board are located between the third shell and the fourth shell.

Optionally, the third shell has a third positioning hole, the fourth shell has a fourth positioning hole, the second circuit board has a second circuit board positioning hole, and a fixing device passes through the third positioning hole, the second circuit board positioning hole and the fourth positioning hole to fix the second circuit board between the third shell and the fourth shell.

Optionally, a surface of the cable has an embossed pattern.

In contrast to the conventional art, the present invention adapting cable structure has a first fixing part and a second fixing part. The first fixing part and the second fixing part are used to fix the cable and the circuit boards. Furthermore, a pattern of a text or a specific design is placed on the cable. The pattern is used to improve the appearance or the identification of the cable. The present invention not only makes the cable firmer and not easy to loose, but also improves the assembly/disassembly capability of the adapting cable structure.

BRIEF DESCRIPTION OF THE DRAWINGS

FIG. 2 is welded on a first circuit board and a second circuit board and a connector is welded on the second circuit board.

DETAILED DESCRIPTION OF PREFERRED EMBODIMENTS

To comprehend the features, methods, intended functions, and objects of the present disclosure, the practical embodiments will be listed, and the figures and the illustration numbers are as follows.

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side, longitudinal/vertical, transverse/horizontal, etc., are only directions by referring to the accompanying drawings, and thus the used directional terms are used to describe and understand the present invention, but the present invention is not limited thereto.

Figure 1:
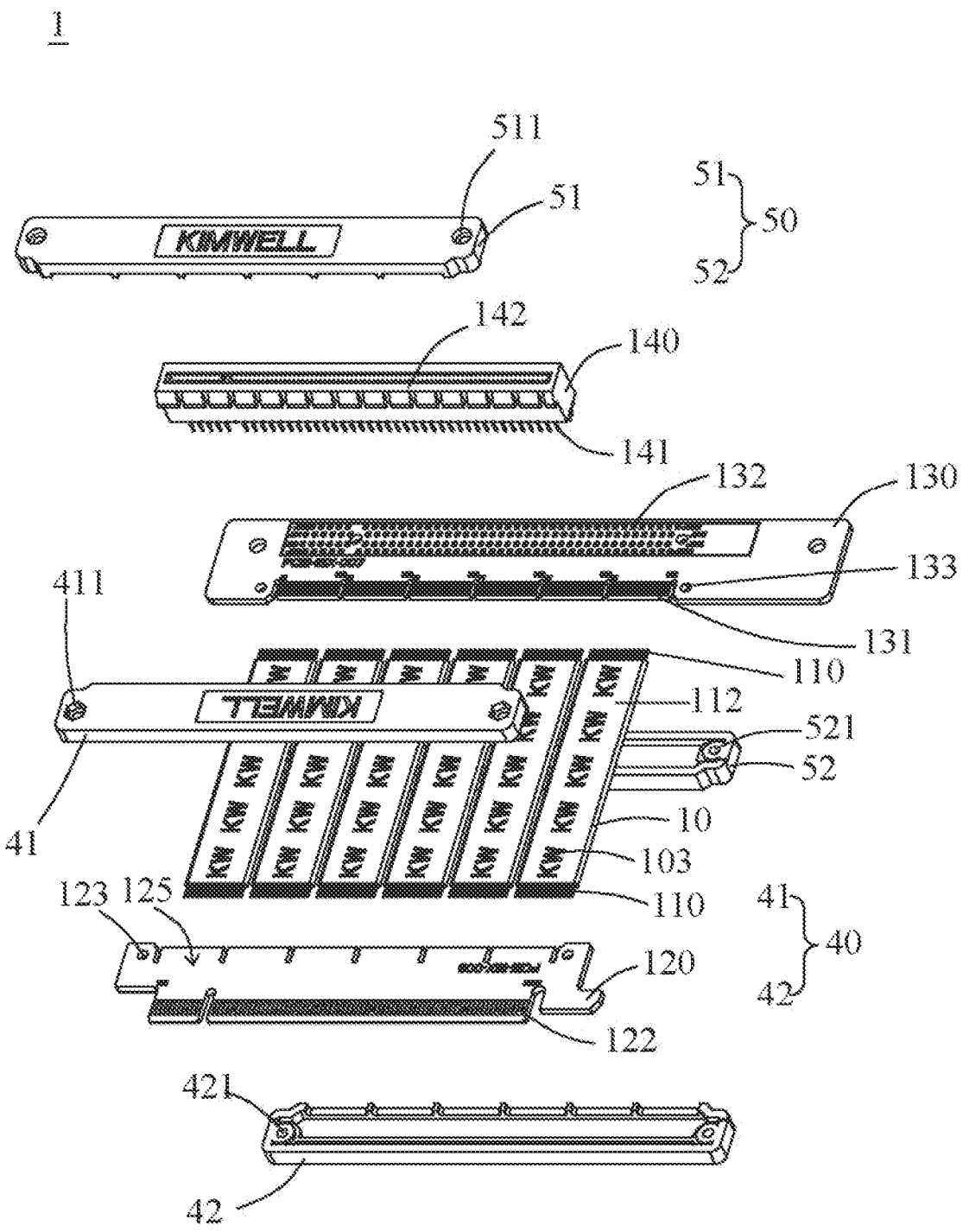
FIG. 1 and FIG. 2 are exploded views of an adapting cable structure in opposite viewing angles according to an embodiment of the present invention.
Figure 2:
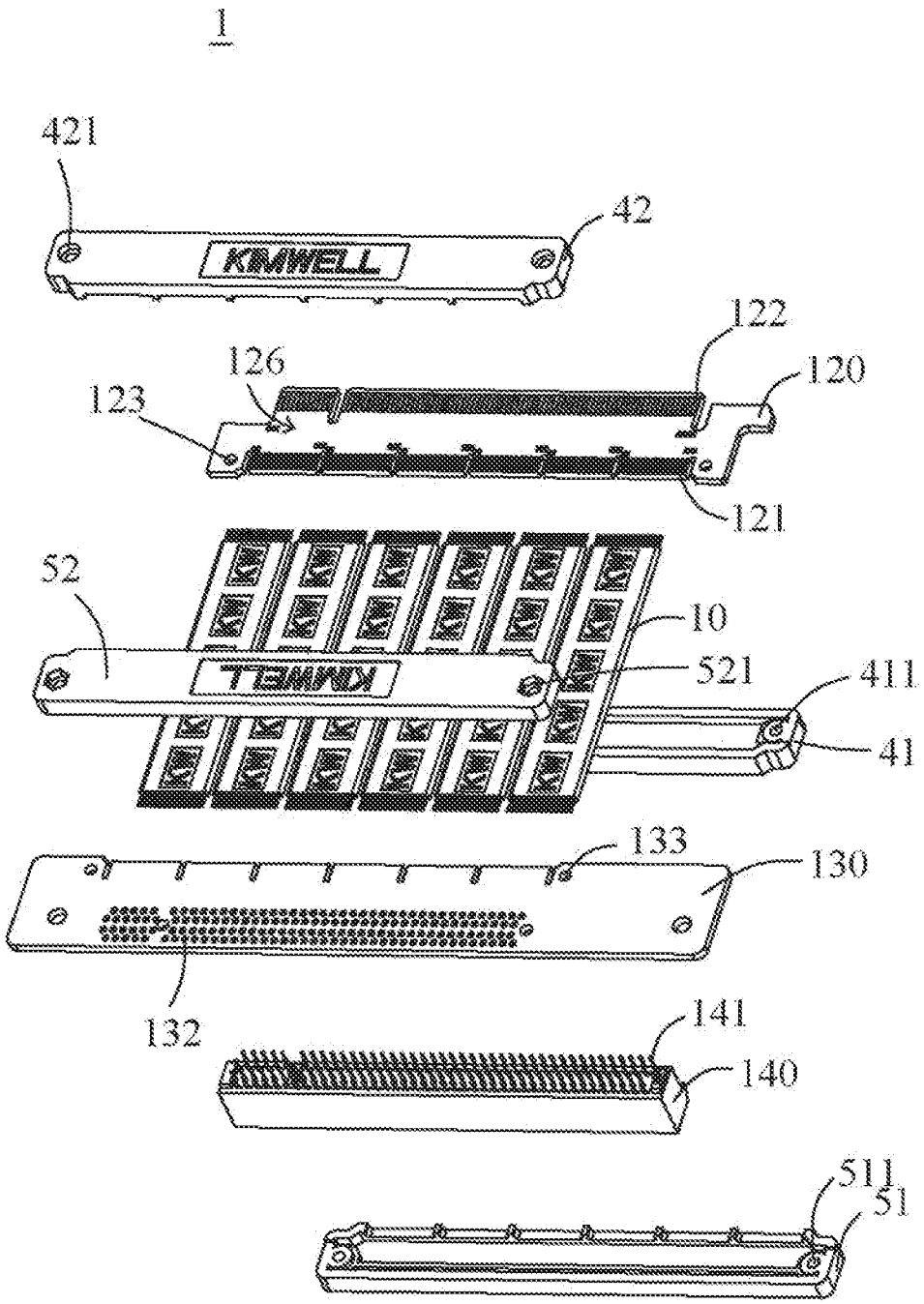

Please refer to FIG. 1 and FIG. 2. FIG. 1 and FIG. 2 are exploded views of an adapting cable structure 1 in opposite viewing angles according to an embodiment of the present invention. The adapting cable structure 1 comprises a cable 10, a first circuit board 120, a second circuit board 130, a connector 140, a first fixing part 40 and a second fixing part.

The cable 10 could be a signal wire or a power wire. The cable 10 comprises a plurality of conductors 110 and a cover 112. The conductors 110 are used to transfer electric signals, power signals or control signals. The cover 112 could be made with a transparent material or a non-transparent material and could cover and protect the conductors 110. The first circuit board 120 comprises a plurality of first welding parts 121 and a plurality of contacting parts 122. The first welding parts 121 are connected to an end of the cable 10. Another end of the cable is placed on the second circuit board 130. The contacting parts 122 are placed on the first surface 125 or the second surface 126 of the first circuit board 120. The second circuit board 130 comprises a plurality of welding parts 131 and a plurality of third welding parts 132. The second welding parts 131 and the third welding parts 132 are placed on the second circuit board 130. One end of the cable 10 is connected to the first welding parts 121 and another end of the cable 10 is connected to the second welding parts 131. The connector 140 comprises a plurality of connector pints 141 and a socket 142. Each of the connector pins 141 are connected to the corresponding welding parts 132. The socket 142 is used to insert another electronic device. The cable 10 has a pattern 103 on it. The pattern 103 could be a text or a specific design. The first fixing part 40 is used to fix the first circuit board 120. The second fixing part 50 is used to fix the second circuit board. Here, the first fixing part 40 or the second fixing part 50 could fix the cable 10 on the first circuit board 120 or the second circuit board 130 (not shown) in a molding process.

The number of the plurality of the contacting parts 122 is greater than the number of the plurality of first welding parts 121. The distance between two adjacent contacting parts 122 of the plurality of contacting parts 122 is longer than the distance between two adjacent welding parts 121 of the plurality of first welding parts 121. The number of the third welding parts 132 is greater than the number of the second welding parts 131 and the distance between two adjacent third welding parts 132 of the third welding parts 132 is longer than the distance between two adjacent second welding parts 131 of the second welding parts 131. The third welding parts 132 are used to be welded with the connector pins 141.

Figure 3:
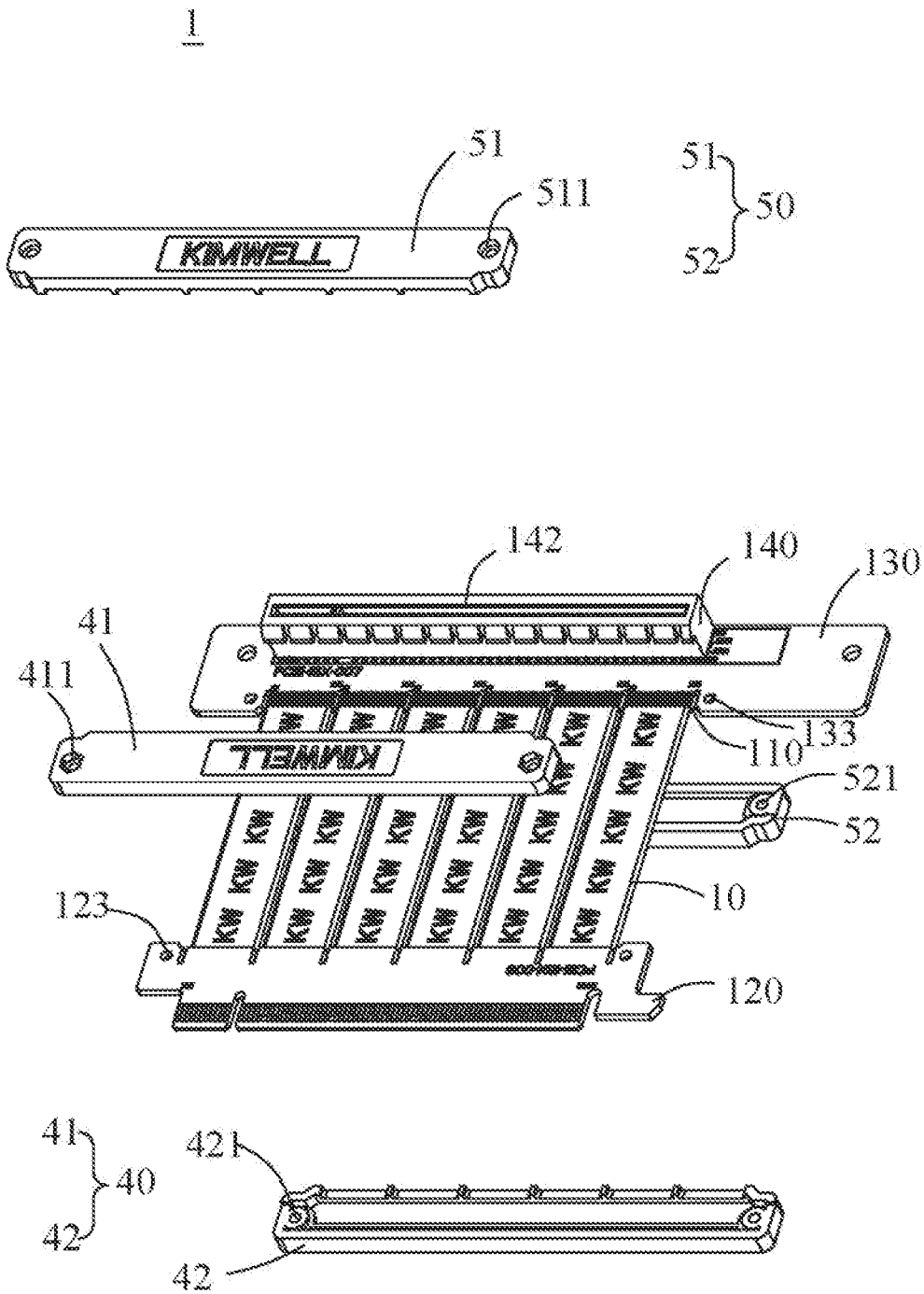
FIG. 3 and FIG. 4 are diagrams showing a structure where a cable shown in FIG. 1
Figure 4:
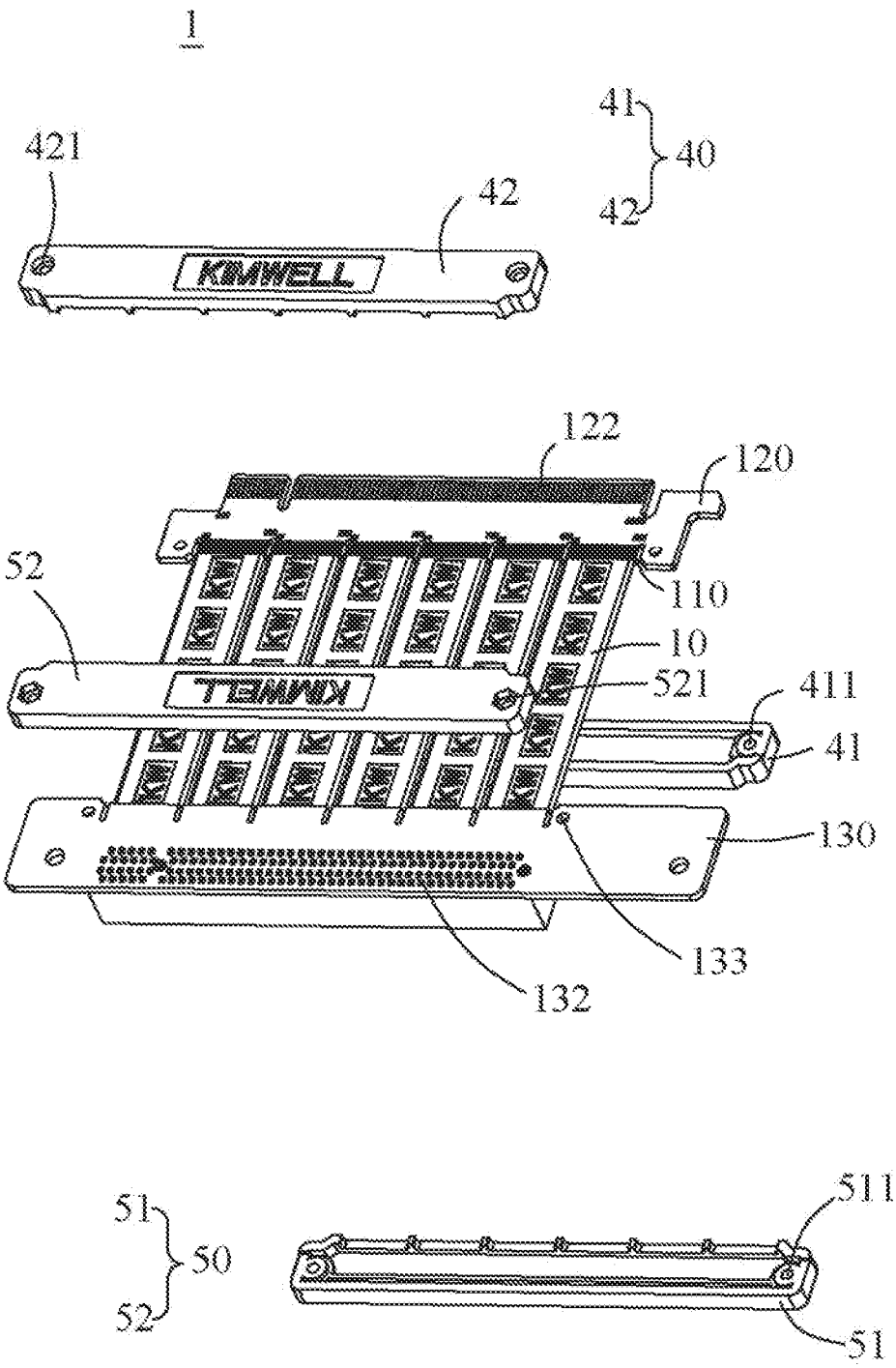

Please refer to FIG. 1-FIG. 4. FIG. 3 and FIG. 4 are diagrams showing a structure where the cable 10 shown in FIG. 1 and FIG. 2 is welded on the first circuit board 120 and the second circuit board 130 and the connector 140 is welded on the second circuit board 130. The first fixing part 40 comprises a first shell 41 and a second shell 42. The first shell 41 comprises a first positioning hole 411. The second shell 42 comprises a second positioning hole 421. The first circuit board 120 comprises a first circuit board positioning hole 123. The second fixing part 50 comprises a third shell 51 and a fourth shell 52. The third shell 51 comprises a third positioning hole 511. The fourth shell 52 comprises a fourth positioning hold 521. The second circuit board 130 comprises a second circuit board positioning hole 133. The first welding parts 121 of the first circuit board 120 are located between the first shell 41 and the second shell 42. The second welding parts 131 of the second circuit board 130 are located between the third shell 51 and the fourth shell 52.

Figure 5:
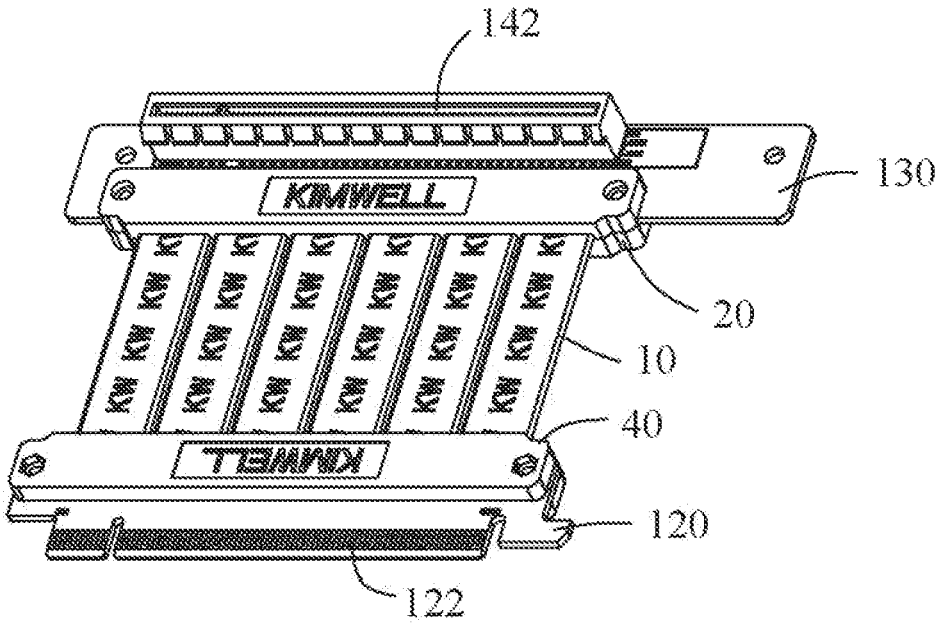
FIG. 5 and FIG. 6 are diagrams showing the assembled adapting cable structure shown in FIG. 1 and FIG. 2.
Figure 6:
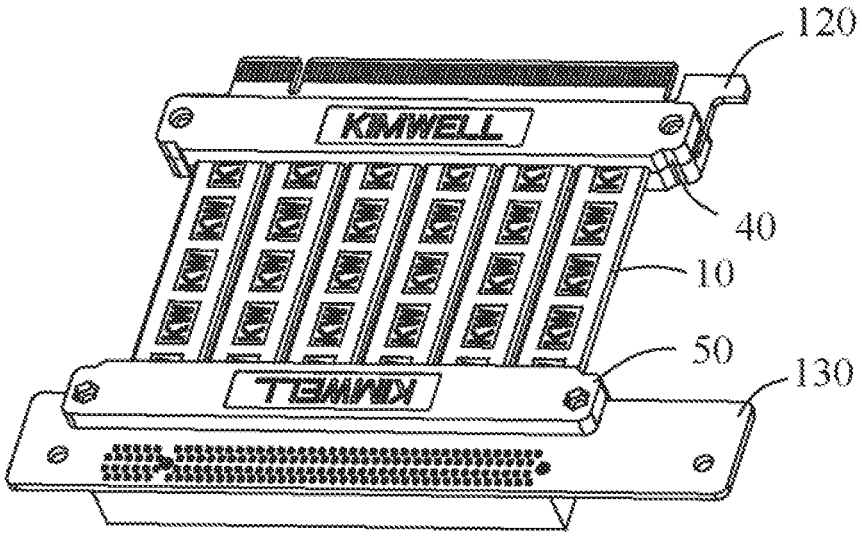

Please refer to FIG. 3-FIG. 6. FIG. 5 and FIG. 6 are diagrams showing the assembled adapting cable structure 1 shown in FIG. 1 and FIG. 2. In this embodiment, a fixing device (such as a screw) passes through the first positioning hole 411, the first circuit board positioning hole 123 and the second positioning hole 421 to fix the first circuit board 120 between the first shell 41 and the second shell 42. Accordingly, the first shell 41 and the second shell 42 fix the first circuit board 120 between the first shell 41 and the second shell 42. Furthermore, the conductors 110 and the first welding parts 121 are covered by the first shell 41 and the second shell 42. This could prevent from breaking the conductors 110 when the conductors 110 are welded on the first welding part 121. In addition, a fixing device (such as a screw) passes through the third positioning hole 511, the second circuit board positioning hole 133 and the fourth positioning hole 521 to fix the second circuit board 130 between the third shell 51 and the fourth shell 52. Accordingly, the third shell 51 and the fourth shell 52 fix the second circuit board 130 between the third shell 51 and the fourth shell 52. Furthermore, the conductors 110 and the second welding parts 131 are covered by the third shell 51 and the fourth shell 52. This could prevent from breaking the conductors 110 when the conductors 110 are welded on the second welding part 131.

Figure 7:
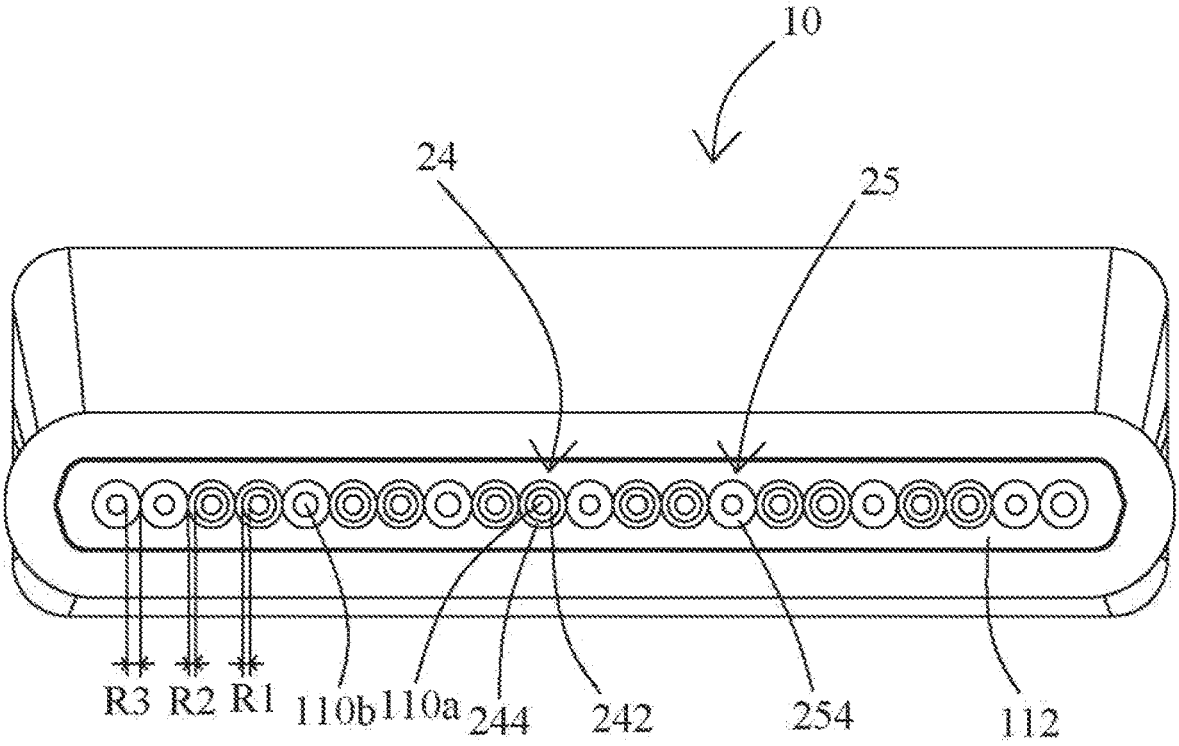
FIG. 7 is a cross-section diagram of a cable according to an embodiment of the present invention.

Please refer to FIG. 7. FIG. 7 is a cross-section diagram of the cable 10 according to an embodiment of the present invention. The cable 10 comprises first signal wires 24, second signal wires 25 and a cover 112. The first signal wires 24 and the second signal wires 25 are parallel to each other and all covered by the cover 112. The cross-section of the first signal wire 24 and the second signal wire 25 has a round shape.

The first signal wire 24 comprises a conductor 110*a* and a first insulating coat 242. The second wire 25 comprises a conductor 110*b* and a third insulating coat 254. The third insulating coat 254 covers the conductor 110*b*. The conductor 110*a* and the conductor 110*b* protrude the first insulating coat 242 and the third insulating coat 254. The protruded conductor 110*a* and the conductor 110*b* could be respectively welded with the first welding part 121 and the second welding part 131.

The first signal wire 24 further comprises a second insulating coat 244. The second insulating coat 244 covers the first insulating coat 242. In this way, the first signal wire 24 is covered by the first insulating coat 242 and the second insulating coat 244. The thickness R3 of the third insulating coat 254 is greater than the thickness R1 of the first insulating coat 242 or the thickness R2 of the second insulating coat 242.

In this embodiment, the first insulating coat 242 and the second insulating coat 244 are respectively made with materials having different dielectric constants. The third insulating 254 covering the conductor 110*b* is made with a material of a different dielectric constant. Preferably, the dielectric constant of the second insulating coat 244 is higher than the dielectric constant of the first insulating coat 242. Please note, this is only an example, not a limitation of the present invention. By adjusting the dielectric constants or structures of the first insulating coat 242, the second insulating coat 244 and the third insulating coat 254, the impedance of the cable 10 could be adjusted.

The first insulating coat 242, second insulating coat 244, and third insulating coat 254 may be insulating materials with highly thermal resistance such as polyethylene (PE), polyvinyl chloride (PVC), Thermoplastic Elastomer (TPE), Thermoplastic Polyurethane (TPU), thermoplastic rubber (TPR), Thermoplastic Polyolefin (TPO), Polyurethane (PUR), Polypropylene (PP), Polyolefins (PO), PolyVinyliDene Fluoride (PVDF), Ethylene-chlorotrifluororthylene copolymer (ECTFE), ethylene-tetra-fluoro-ethylene (ETFE), Teflon Fluorinated ethylene propylene (Teflon FEP), Polytetrafluoroethene (PTFE), Teflon, and nylon. The conductor 110*a* and conductor 110*b* may be a highly thin, flat tinned copper wire.

Figure 8:
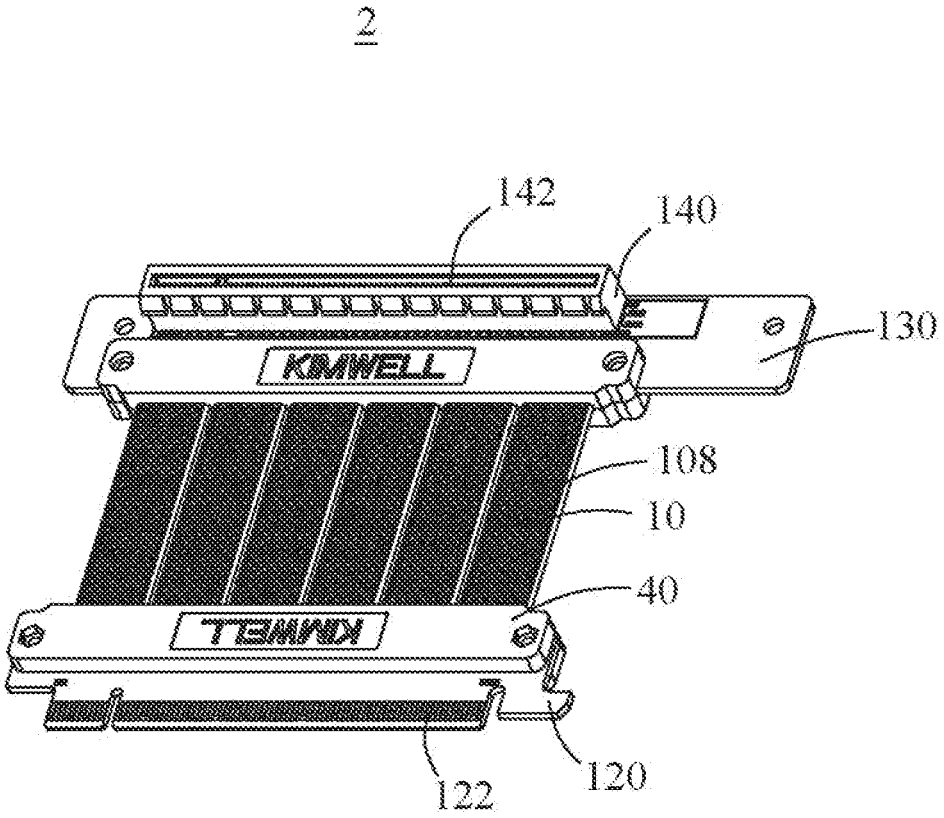
FIG. 8 is a diagram showing an assembled adapting cable structure according to another embodiment of the present invention.

FIG. 8 is a diagram showing an assembled adapting cable structure 2 according to another embodiment of the present invention. The adapting cable structure 2 comprises a cable 10, a first circuit board 120, a second circuit board 130, a connector 140, a first fixing part 40 and a second fixing part 50. The cable 10 could be a signal wire or a power wire. The cable 10 comprises a plurality of conductors 110 and a cover 112. The conductors 110 are used to transfer electric signals, power signals or control signals. The cover 112 could be made with transparent or non-transparent materials and covers and protects the conductors 110. The first fixing part 40 is used to fix the first circuit board 120 and the second fixing part 50 is used to fix the second circuit board 130.

The cover 112 of the cable 10 has an embossed pattern. The embossed pattern 108 could be a pattern of several parallel lines, curves, regularly arranged circles/ovals/triangles/rectangular/diamonds/hexagons, non-regularly arranged design, or several bumps. Preferably, the embossed pattern 108 comprises several bended lines, which are not parallel to the direction of the conductors 110 in the top view. The embossed pattern 108 could be generated through pressing the cover 112 by the automatic press equipment.

Except for the embossed pattern 108 on the cover 112 of the cable 10, in this embodiment, the cable 10 of the adapting cable structure 2, the first circuit board 120, the second circuit board 130, the connector 140, the first fixing part 40 and the second fixing part 50 have similar functions and structures as those corresponding components in the adapting cable structure 1 and thus further illustration is omitted here.

In contrast to the conventional art, the present invention adapting cable structure has a first fixing part and a second fixing part. The first fixing part and the second fixing part are used to fix the cable and the circuit boards. Furthermore, a pattern of a text or a specific design is placed on the cable. The pattern is used to improve the appearance or the identification of the cable. The present invention not only makes the cable firmer and not easy to loose, but also improves the assembly/disassembly capability of the adapting cable structure.

Above are embodiments of the present invention, which does not limit the scope of the present invention. Any modifications, equivalent replacements or improvements within the spirit and principles of the embodiment described above should be covered by the protected scope of the invention.

What is claimed is:

1. An adapting cable structure, comprising:

a cable, configured to transfer a power signal or a control signal;

a first circuit board, comprising a plurality of contacting parts and a plurality of first welding parts, the plurality of welding parts are connected to one end of the cable; and a second circuit board;

a first fixing part, configured to fix the first circuit board, wherein the first fixing part comprises a first shell and a second shell, and the first welding parts of the first circuit board are located between the first shell and the second shell;

wherein another end of the cable is on the second circuit board and the plurality of the contacting parts are located at two sides of the first circuit board, wherein the first shell has a first positioning hole, the second shell has a second positioning hole, the first circuit board has a first circuit board positioning hole, and a fixing device passes through the first positioning hole, the first circuit board positioning hole and the second positioning hole to fix the first circuit board between the first shell and the second shell.

2. The adapting cable structure of claim 1, wherein a number of the plurality of the contacting parts is greater than a number of the plurality of first welding parts, and a distance between two adjacent contacting parts of the plurality of contacting parts is longer than a distance between two adjacent welding parts of the plurality of first welding parts.

3. The adapting cable structure of claim 1, wherein the second circuit board comprises a plurality of second welding parts and a plurality of third welding parts, and the plurality of the second welding parts are connected at one end of the cable.

4. The adapting cable structure of claim 3, further comprising:

a connector, comprising a plurality of connector pins, welded with the plurality of third welding parts.

5. The adapting cable structure of claim 3, wherein a number of the third welding parts is greater than a number of the second welding parts and a distance between two adjacent third welding parts is longer than a distance between two adjacent second welding parts.

6. The adapting cable structure of claim 1, wherein the cable comprises a plurality of first conductors and a plurality of second conductors, each of the first conductors is covered by a first insulating coat and each of the second conductors is covered by a third insulating coat.

7. The adapting cable structure of claim 6, wherein the cable comprises a plurality of second insulating coats, and each of the first insulating coats is covered by one of the second insulating coats.

8. The adapting cable structure of claim 7, wherein a thickness of the third insulating coats is greater than a thickness of the first insulating coats or a thickness of the second insulating coats.

9. The adapting cable structure of claim 1, wherein a surface of the cable has an embossed pattern.

10. An adapting cable structure, comprising:

a cable, configured to transfer a power signal or a control signal;

a first circuit board, comprising a plurality of contacting parts and a plurality of first welding parts, the plurality of welding parts are connected to one end of the cable; and a second circuit board;

a second fixing part, configured to fix the second circuit board, wherein the second fixing part comprises a third shell and a fourth shell, and the second welding parts of the second circuit board are located between the third shell and the fourth shell;

wherein another end of the cable is on the second circuit board and the plurality of the contacting parts are located at two sides of the first circuit board, wherein the third shell has a third positioning hole, the fourth shell has a fourth positioning hole, the second circuit board has a second circuit board positioning hole, and a fixing device passes through the third positioning hole, the second circuit board positioning hole and the fourth positioning hole to fix the second circuit board between the third shell and the fourth shell.

11. The adapting cable structure of claim 10, wherein a surface of the cable has an embossed pattern.

* * * * *